United States Patent [19]

van de Wetering

[11] 4,273,373

[45] Jun. 16, 1981

[54] HOIST CLAMP

[75] Inventor: Martinus B. van de Wetering, Zeist, Netherlands

[73] Assignee: Interproduct B.V., Driebergen, Netherlands

[21] Appl. No.: 44,972

[22] Filed: Jun. 4, 1979

[30] Foreign Application Priority Data

Jun. 8, 1978 [NL] Netherlands ..... 7806250

[51] Int. Cl.[3] ..... B66C 1/48

[52] U.S. Cl. ..... 294/101; 294/104

[58] Field of Search ..... 294/101, 102 R, 103 R, 294/104, 114, 96, 86 R, DIG. 1; 24/263 SW

[56] References Cited

U.S. PATENT DOCUMENTS 2,360,602 10/1944 Waldrup ..... 294/104

3,843,186 10/1974 van de Wetering ..... 294/101

*Primary Examiner*—James B. Marbert

*Attorney, Agent, or Firm*—Haseltine and Lake

[57] ABSTRACT

Hoist clamp for clampingly gripping plate-shaped pieces, comprising a smooth eccentric clamping segment constituting part of a spring operated toggle lever system and co-operating with a smooth counter clamping segment which is part of a wedge, a locking mechanism comprising a rotatable circular disc of which the circumferential face acts upon the one lever of the toggle lever system, a segment of this disc having been removed to allow stretching of the toggle lever system, such that the blocking of the wedge is first released before the unlocking of the toggle lever, and said disc being further engaged by a chain guided past a guide roller and engaging at its other end the wedge against the action of a wedge spring.

8 Claims, 2 Drawing Figures

HOIST CLAMP

BACKGROUND OF THE INVENTION

The invention relates to a hoist clamp, constructed for clampingly gripping plate-shaped pieces to be hoisted.

Hoist clamps for plates are known, which comprise a smooth eccentric round clamping segment constituting part of a spring operated toggle lever system, on which at the other end the hoist eye operates, and which co-operates with a smooth flat counter clamping segment which is adjustable in the direction of the thickness of the plate material to be gripped. The counter clamping segment constitutes part of a movable body realized as a wedge, which co-operates—by means of toothed faces—with a stationary block and which urges the counter clamping segment under spring action in the direction of the smallest thickness of the plate after a locking mechanism acting upon the toggle lever system has been released. A double locking mechanism is provided, to be operated by means of a handle, and which in the locking position acts upon the toggle lever system to lock it in its most-folded condition in which the eccentric clamping segment is inoperative, and which is further capable of blocking the wedge in the non-operative position. The construction is such that the blocking of the wedge is first released, without change of position of the toggle lever, before the unlocking of this toggle lever can be brought about.

Such a hoist clamp is disclosed in U.S. Pat. No. 3,843,186 of the same inventor.

As is disclosed in the specification of the prior patent that invention aimed at providing a hoist clamp which is adapted for gripping plate material of which the surface of which should not be damaged. Therefore the eccentric clamping segment may not, as is known with other hoist clamp types, be toothed, but it should have a smooth surface. In order to nevertheless obtain a sufficient clamping force it is then necessary to change the dimensioning in this way that the ratio between the path of displacement of the hoist eye and the change of radius of the eccentric clamping element is selected at a greater value. This implies, however, that the maximum extent of the change of radius of the eccentric clamping element is reduced to a fraction, so that it is not possible anymore to process any plate thickness value.

This purpose is served by the special wedge shaped structure of the counter clamping segment with toothed faces, a control lever and a locking mechanism, by which the counter clamping segment always finds the correct position for each and any value of plate thickness to be gripped before, in hoisting, the toggle lever system is able to develop the definitive clamping force.

Further there was introduced a double locking. With this it is possible to release in a first stage during the unlocking only the wedge, so that this wedge is able to confine the thickness of plate present at that moment, and to subsequently have the toggle lever stretch itself forcefully and suddenly, whereby clamping force is being built up and the wedge will, with complete certainty, engage the teeth which have come to lie opposite it in the first stage. The strong spring acting upon the toggle lever is not involved in the play of forces in the first stage of unlocking. Only in the second stage the unlocking of the toggle lever system will take place, whilst at that same time the compressed spring will exert a force upon the toggle lever in order to finally bring the teeth of the wedge into engagement.

The locking mechanism in the prior structure was comprised by two locking cams, operated by a same operating lever at the outside of the frame of the clamp, and one of which is acting upon the toggle lever system and the other upon a separate lever for the wedge. The operation of this system is excellent but it is sensitive, amongst other things to fouling and to certain deformations which, irrespective of how robust such a hoist clamp is usually realized, do occur sometimes in practice, for example when it is overloaded. Also, with the prior embodiment, it may occur that, if the clamp is being put onto the plate to be hoisted in a slanting position, the counter clamping segment will not confine the plate well and flatly, which means a loss of part of the effectivity of the eccentric clamping segment.

SUMMARY OF THE INVENTION

The principal object of the present invention is therefore to provide a hoist clamp for plates the surface of which is not allowed to be damaged, such hoist clamp having the positive features of the prior structures such as:

the maximum width of the clamp's slit in the inoperative condition, the double locking, the automatic adaptation to the thickness of each individual plate to be clamped, the forceful and sudden confining of the plate, the great clamping force, but moreover having features such as:

increased reliability, comprising certainty of a correct final position of the clamp even in case of initial misplacement, a decreased sensitivity to, e.g., dirt and overcharging.

It is a further object of the invention to provide such a hoist clamp having a simple construction and being relatively inexpensive in manufacture.

In the hoist clamp according to the present invention the locking mechanism comprises a rotatable circular disc, arranged at the same side of the lateral central plane of the clamp where the wedge with the counter clamping segment is located, and of which the circumferential face acts upon the one lever of the toggle lver system close to the point of engagement of the hoist eye in view of blocking the toggle lever system in its most-folded position, of which circular disc a segment shaped portion has been removed in order to allow in the corresponding area of angular positions stretching of the toggle lever system, and said disc being further provided with a pin which is engaged by a chain guided past a guide roller and engaging at its other end the wedge against the action of the wedge spring.

DESCRIPTION OF THE DRAWINGS

For a better understanding of the invention and to show how the same may be carried into effect, reference will now be made, by way of example, to the accompanying drawings, in which.

DESCRIPTION OF THE PREFERRED EMBODIMENT

Figure 1:
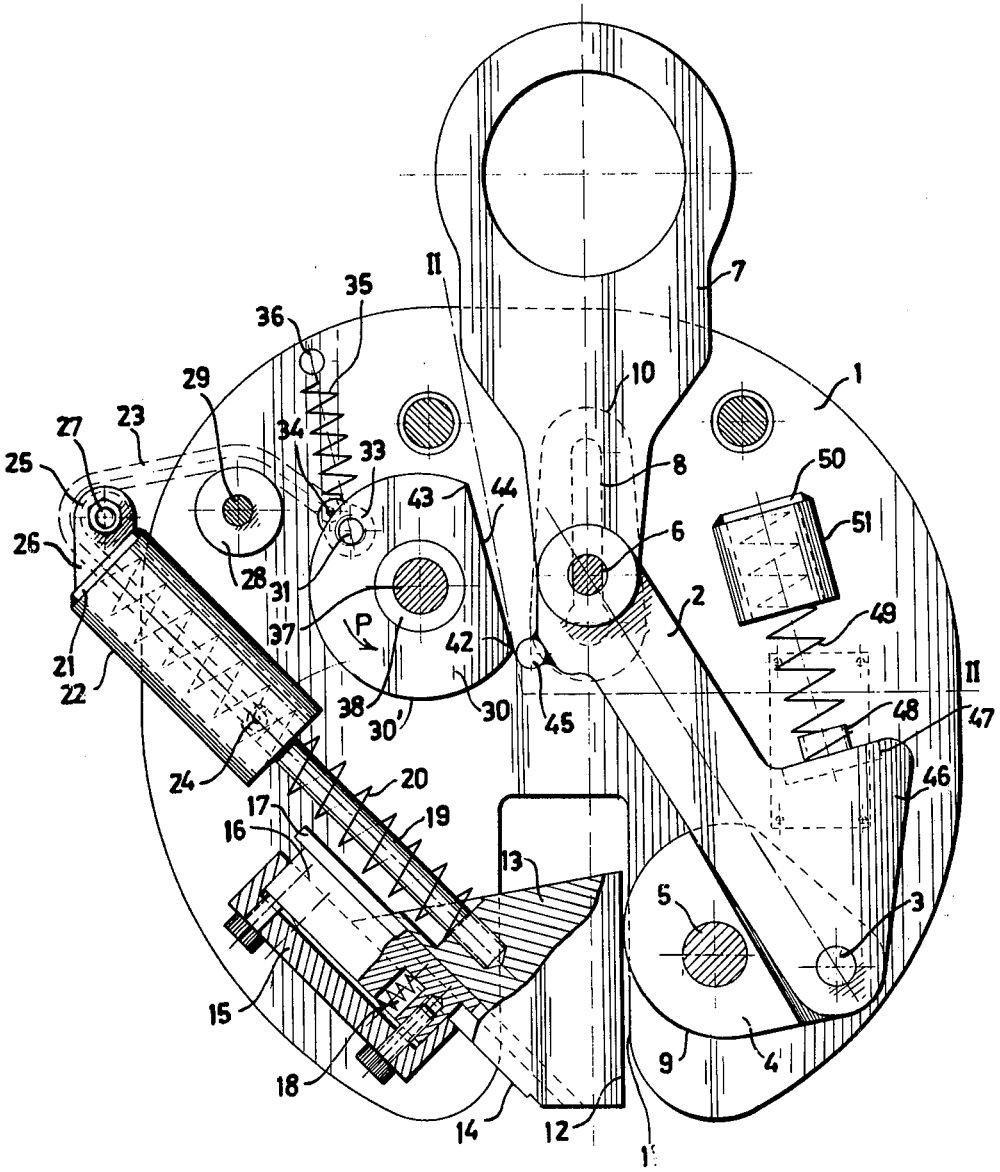
FIG. 1 represents an elevation of the hoist clamp, omitting the front side plate of a pair of side plates between which the moving parts are provided.

In FIG. 1 the reference numeral 1 indicates the rear side plate of the pair of parallel plates between which, in the usual manner, the hoist clamp parts are confined. The corresponding front side plate (which is visible in the cross-sectional view of FIG. 2, indicated by 1'), has been omitted in FIG. 1 in order to show the various levers. Just like in the prior construction according to U.S. Pat. No. 3,843,186 the clamping mechanism comprises a lever 2 having a pivot pin 3 with a second or lower lever 4. The latter has a fixed pivot pin 5 in the side plates 1, 1', the upper end of lever 2 having a pivot pin at the lower end of the hoisting eye 7. The hoisting eye 7 is vertically movable since pin 6 runs in a vertical guideway 8 in the side plates 1, 1' below a reinforcement plate 10 on the exterior of one of the side plates, indicated in phantom lines.

The effective or operating surface 9 of the lower lever 4 has a radius of curvature of which the center lies eccentric with respect to the axis of the pin 5 of this lever. Initially the pin 6 finds itself at the lower part of the guideway 8; when a hoisting force is produced the pin 6 will move upwards in the guideway so that the toggle lever system 2, 4 is slightly stretched and a greater radius of the operative surface 9 with respect to the axis of the pin 5 becomes effective at the location of the plate to be clamped. No such plate is shown in the drawings. The clamp is shown in "closed" condition without inclusion of a plate, such plate being introduced in the slit 11. By the aforementioned action of the eccentric lever 9 between the side plates 1, 1' at one side of the clamp's slit 11 the plate is pressed against a counter pressure segment 12 at the opposite side. The counter segment is—in the type of hoisting clamp concerned here intended as it is to operate without producing any damage to the plates clamped—smooth, as is the curved surface 9 of lever 4.

The counter pressure surface 12 constitutes part of a wedge 13 which has toothing on its inclined rear face 14. Stationarily arranged with respect to the side plates is a block 15 which is also, on its face directed to the wedge, provided with toothing 16.

Block 15 carries a T-profile slide 17 along which, engaged in a correspondingly sectioned slot, the wedge 13 is movable in a direction parallel to the toothed faces 14, 16. In the absence of a compressive force on the wedge, i.e. when no plate is clamped, the toothed faces 14, 16 of the wedge and the block, respectively, are pressed away from each other over a short distance because the T-shaped slide 17 is movable in a direction at right angles to the toothed face 16 under the influence of a pair of compression springs 18 provided within the block. Further particulars of the structure of block and wedge can be found in the abovementioned patent. Resuming the structure, as far as of importance here, is such that, in the absence of any clamping force, the wedge and block are capable of unhampered movement parallel to each other in a direction making an acute angle with the main surface of the plate to be handled in the clamp slit 11.

In the wedge 13 a pin 19 is provided which carries around it a compression spring 20 urging the wedge obliquely downwards as far as this is not prevented by a locking mechanism yet to be described.

The spring 20 with its other end lies against the end wall 21 of sleeve 22 fixedly arranged between and with respect to the side plates 1, 1'. This end wall 21 is provided with a central aperture which is smaller than the internal diameter of the compression spring 20, but sufficiently big for letting a chain 23 pass, which chain is fixed with one of its ends by means of a pin 24 to the end of pin 19. Further upwards the chain 23 is guided past a rotatable sleeve 25 located between two ears such as 26 provided on the top plate 21 of the sleeve containing the spring. This sleeve 25 is held at its place by a bolt and a nut 27. The spring 20 has such a length that part of the spring mechanism extends outside the circumference of the hoist clamp's side plates 1, 1'. These dimensions have been chosen in order to obtain with a wide clamping slit aperture (so also a long displacement path of the wedge 13) at the same time a great force to confine the plate in the clamp slit by means of the wedge, also when initially the clamp is placed on the plate in a slanting position.

From the sleeve 25 the chain 23 is subsequently led past a guide roller 28 which is rotatable about a pin 29 supported by the side plate 1.

Figure 2:
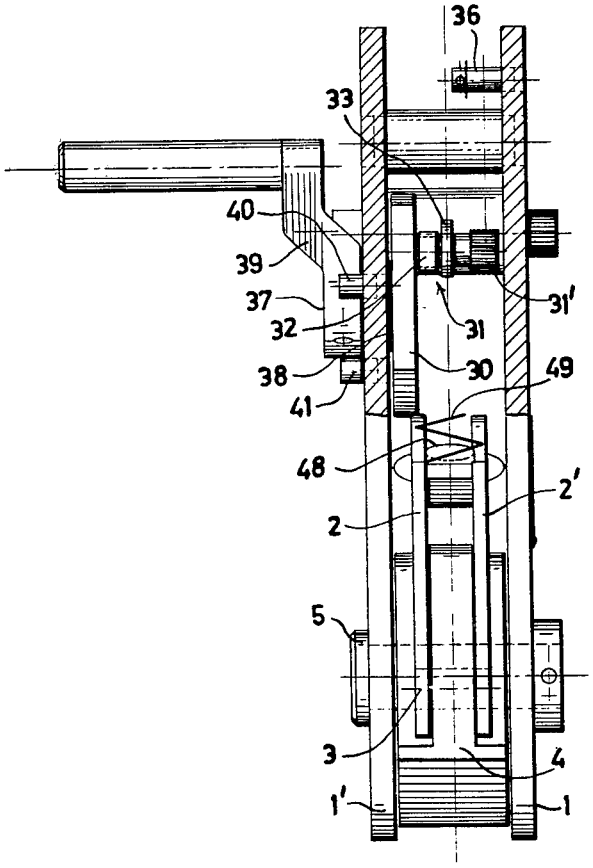
FIG. 2 is a sectional view according to the arrows II—II in FIG. 1.

The extreme end of the chain 23 is affixed to the disc 30 in a manner which becomes particularly apparent when comparing FIG. 1 and FIG. 2. The disc 30 is located at short spacing with respect to the front side plate 1' and bears at its rear a pivot pin 31 having a head 31'. 32 Is a filling bus behind which the pivot member 33 is provided on pin 31, such member being, as appears from its name, pivotal about pin 31 and having affixed to it shaft 34 of the final link of chain 33 (visible in FIG. 1, and for the sake of clarity omitted in FIG. 2). The head 31 can be engaged by the one end of a tension spring 35, the other end of which is affixed to a spring fixation pin 36 provided on the rear side plate 1.

The lock disc 30 is fixedly arranged on a spindle 37 which is, whilst providing a thin washer 38 in between, pivotally bearing in the front side plate 1' and which protrudes from this at the outside, so that on the protruding end of spindle 37 the handle lever 39 can be provided. With this the lock disc 30 can be pivoted through more than half a turn, as will be clarified below, between two stop members 40 and 41 for the handle provided on the outside.

The lock disc 30 is circular over a sector which, in this embodiment, amounts to nearly 270°, but between points 42 and 43 a segment has been cut off resulting in a straight face 44.

Co-operating with the lock disc 30, both the circular part and the cut off straight face 44, is a cylindrical pin 45 which is welded to lever 2 of the toggle lever system 2-4. The co-operation between pin 45 and the circumferential face of the disc is determined by the fact that the toggle lever system 2-4 is under spring action. At the other side and near the pivot pin 3 lever 2 is provided with a broadened part. From FIG. 2 it is visible that this lever in fact consists of two elements 2 and 2' of the same shape, which are located on either side of the eccentric lever 4 of the toggle lever system in which the pin 3 of the system is located. Between the broadened parts 46 of the elements 2, 2' of this lever a bridging plate 47 is provided as a support for a sleeve 48 about which a compression spring 49 is provided. The upper end of this spring abuts against the end face 50 of a sleeve 51 fixedly arranged with respect to the side plates of the clamp frame.

In the absence of any hoisting force the compression spring 49 results in the toggle lever system 2-4 assuming its most folded position, as represented in FIG. 1. In this condition the eccentric clamping segment 4 is always entirely in its initial position, so that always the full extent of eccentricity is available for building up clamping force. The cylindrical pin 45, which is to function as cam follower, will not touch disc 30, as represented.

When, starting from this condition, a hoisting force is exerted the hoisting eye will move upwardly, whereby the pin 6 displaces itself through the guideway 8; the toggle lever 2-4 will be stretched somewhat, whereby spring 49 will be compressed a little, and thereby the eccentric lever 4 will to a minor extent turn about pin 5 and will build up thrust. The upward displacement of the hoisting eye with the pivot pin 6 and the upper portion of lever 2 including the pin 45 affixed thereto, is allowed because in this condition pin 45 can move upwardly unhampered as from the starting point 42 of removed segment 44 of the disc 30.

When by operation of lever 30 the disc is rotated, to wit in counter-clockwise direction in FIG. 1, as indicated by the arrow P, the circular circumference 30' of the disc comes in front of cam follower 45, the straight section 44 being turned away counter-clockwise. Actually the starting point 42 of the straight section 44 need only be rotated a few degrees in order to prevent movement of the toggle lever system 2-4. Ongoing rotation of disc 30 therefore makes no sense from the point of view of changing the blocking condition of the toggle lever, but it will indeed cause ever further pulling of chain 23. In the condition represented the point of engagement 34 for the chain on the disc lies about diametricaly opposite point 42, whilst from there chain 23 extends in the same direction. This condition corresponds with the extreme position of wedge 13 in the direction of confining a clamped plate against clamping segment 4. When disc 30 is rotated chain 23 will therefore pull the clamping segment back against the influence of spring 20. Pulling the wedge 13 back with respect to block 15 is always possible because the obliqueness of the toothing 14, 16 (as was the case with the prior structure) directed such that in the engaged condition the teeth will prevent wedge displacement downwardly to the right, but that the opposite movement precisely disengages the teeth. (The teeth 14 and 16 have not been depicted because as such this structure of inter-engagement between block 15 and wedge 13 belongs to the prior art and is fully disclosed for example in the Patent already mentioned).

When being pulled the chain will be guided past the sleeve 25 and past roller 28. The blocking disc 30 is able to make a turn of between 180° and 270° until the lever 39 abuts against the other stop pin implying that the wedge 13 has reached the extreme open condition. Because the turn exceeds 180° the engagement point 33, 34 of the chain will pass a dead center position, so that the lock disc will find a condition of rest. The same great turn gives the possibility to conquer by hand the force of the strong spring 20.

In order to complete the description of the lock it will now be described how one operates when hoisting a plate, starting from the condition sketched, in which both the wedge and the toggle lever are locked so that the clamp is open.

The open clamp is first placed on a plate. Thereupon by operation of the lever 39, the lock is released, whereby first the chain 23 will be paid out and the wedge 13 will start confining the plate. This goes forcefully, because the strong compression spring 20 acts directly upon the wedge, whilst at the same time the tension spring 35 pulls the upper connecting point of the chain upwardly. By this great force the plate will be well confined and only after this has happened, i.e. all by the end of the circular portion 30' of the circumference of the disc, the blocking of the toggle lever is annihilated, so that at that moment the latter is allowed to start building up the actual hoisting pressure.

What is claimed is:

1. An improved hoist clamp for clampingly gripping plate-shaped pieces, comprising an eccentric round clamping segment constituting one lever of a spring operated toggle lever system on which at the other end the hoisting eye operates, said segment co-operating with a counter clamping segment as is part of a movable wedge and a locking system associated with said wedge; said improvement comprises: having said wedge co-operating with a stationary block, and being connected, by means of a flexible connection, with said locking system.

2. The hoist clamp of claim 1 in which the locking system comprises a rotatable circular disc of which the circumferential face acts upon one lever of the toggle lever system, a segment of this disc having been removed to allow stretching of the toggle lever system whilst blocking the system for the remainder of the circumference.

3. The hoist clamp of claim 1, in which the flexible connection between the wedge, which carries the counter clamping segment, and the locking system is a chain.

4. Hoist clamp, constructed for clampingly gripping plate-shaped pieces to be hoisted, the clamp comprising a smooth eccentric round clamping segment constituting part of a spring operated toggle lever system operatively connected with a hoisting eye, and which co-operates with a smooth flat counter clamping segment which is adjustable in the direction of the thickness of the plate material to be gripped because it constitutes part of a movable body realized as a wedge, which co-operates by means of toothed faces with a stationary block and which urges the counter clamping segment under the influence of spring pressure in the direction of the smallest thickness of the plate material after a locking mechanism acting upon the toggle lever system has been released, a locking mechanism being provided, to be operated by means of a handle, and which in the locking position acts upon the toggle lever system to lock it in its most-folded condition in which the eccentric clamping segment is inoperative, and which is further capable of blocking the wedge in the non-operative position, such that the blocking of the wedge is first released without change of position of the toggle lever before the unlocking of this toggle lever is brought about and wherein further the locking mechanism comprises a rotatable circular disc, arranged at the same side of the lateral central plane of the clamp where the wedge with the counter clamping segment is located, and of which the circumferential face acts upon the one lever of the toggle lever system close to the point of engagement of the hoisting eye in view of blocking the toggle lever system in its most-folded position, of which circular disc a segment shaped portion has been removed in order to allow in the corresponding area of angular positions stretching of the toggle lever system, and said disc being further provided with a pin which is engaged by a flexible connection guided past a guide roller and engaging at its other end the wedge against the action of the wedge spring.

5. The hoist clamp of claim 4 in which the flexible connection is a chain.

6. The hoist clamp according to claim 4, in which the flexible connection is a chain that goes through the end wall of a sleeve containing the wedge spring in order to engage the end of a pin which is affixed to the wedge and which extends within the wedge spring.

7. The hoist clamp of claim 4, in which the lever of the toggle lever system connected with the hoisting eye is provided with a cylindrical pin affixed thereto, of which the circumferential face co-operates with the disc of the lock mechanism.

8. The hoist clamp of claim 4, in which the spring for the toggle lever has a stationary abutment face in a sleeve which is arranged in the clamp frame, the spring at the other end abutting against an operating surface of a broadened part of the lever connected with the hoisting eye.

* * * * *